US007476263B2

(12) United States Patent
Nakazaki et al.

(10) Patent No.: US 7,476,263 B2
(45) Date of Patent: Jan. 13, 2009

(54) COLORING METHOD OF TANGIBLE MATTER HAVING POLYAMIDE BOND AND TANGIBLE MATTER COLORED BY SUCH METHOD

(75) Inventors: Masahiro Nakazaki, Neyagawa (JP); Kunihiro Ohshima, Neyagawa (JP); Kiyoshi Donowaki, Chikushino (JP); Kentaro Kawamura, Fukuoka (JP)

(73) Assignees: Kurashiki Boseki Kabushiki Kaisha, Kurashiki-shi (JP); Fukuoka Prefectural Government, Fukuoka-shi (JP)

( * ) Notice: Subject to any disclaimer, the term of this patent is extended or adjusted under 35 U.S.C. 154(b) by 0 days.

(21) Appl. No.: 10/568,950

(22) PCT Filed: Nov. 8, 2004

(86) PCT No.: PCT/JP2004/016544

§ 371 (c)(1),
(2), (4) Date: Dec. 13, 2006

(87) PCT Pub. No.: WO2005/047591

PCT Pub. Date: May 26, 2005

(65) Prior Publication Data

US 2007/0089247 A1 Apr. 26, 2007

(30) Foreign Application Priority Data

Nov. 12, 2003 (JP) ..... 2003-382358

(51) Int. Cl.
*D06P 3/24* (2006.01)

(52) U.S. Cl. ..... 8/517; 8/595; 8/596; 8/608; 8/404

(58) Field of Classification Search ..... 8/517, 8/596, 595, 608, 404
See application file for complete search history.

(56) References Cited

U.S. PATENT DOCUMENTS

| | | | | | |
|---|---|---|---|---|---|
| 3,993,437 | A | * | 11/1976 | Dickmanns et al. | 8/531 |
| 4,620,852 | A | * | 11/1986 | Nishikawa et al. | 8/515 |
| 5,221,289 | A | * | 6/1993 | Miyamatsu et al. | 8/646 |
| 5,516,338 | A | * | 5/1996 | Pai | 8/596 |
| 5,810,890 | A | * | 9/1998 | Russ et al. | 8/531 |
| 5,861,045 | A | * | 1/1999 | Hall | 8/596 |
| 6,203,579 | B1 | * | 3/2001 | Moeller et al. | 8/409 |
| 6,790,239 | B1 | * | 9/2004 | Moeller et al. | 8/405 |

FOREIGN PATENT DOCUMENTS

| | | | | |
|---|---|---|---|---|
| BG | 50051 | A3 | * | 4/1991 |
| BG | 50051 | A | | 4/1992 |
| GB | 219995 | | | 10/1924 |
| JP | 43-24207 | | * | 10/1943 |
| JP | 33-7493 | B | | 8/1958 |
| JP | 43-24207 | B | | 10/1968 |
| JP | 58045401 | | * | 11/1978 |
| JP | 58-45401 | B2 | | 10/1983 |
| JP | 2000-143683 | A | | 5/2000 |
| JP | 2001-055672 | | * | 2/2001 |
| JP | 2001-55672 | A | | 2/2001 |
| WO | 98/47472 | | * | 10/1998 |
| WO | 01/34106 | | * | 5/2001 |

* cited by examiner

*Primary Examiner*—Lorna M. Douyon
*Assistant Examiner*—Amina Khan
(74) *Attorney, Agent, or Firm*—Birch, Stewart, Kolasch & Birch, LLP

(57) ABSTRACT

A coloring method of a tangible matter having a polyamide bond, characterized in that the tangible matter having a polyamide bond is treated with an aqueous solution containing an aromatic derivative having one or more hydroxyl groups and a metal salt at a temperature of 40° C. or more, and a polyamide tangible matter colored by such a method.

4 Claims, No Drawings

COLORING METHOD OF TANGIBLE MATTER HAVING POLYAMIDE BOND AND TANGIBLE MATTER COLORED BY SUCH METHOD

TECHNICAL FIELD

This invention relates to a coloring method of a tangible matter having a polyamide bond (hereinafter, referred to as "polyamide tangible matter") and a tangible matter colored by such a method.

PRIOR ART

Conventionally, a coloring method using plant dyes has been known as a method for dyeing fibers. The coloring method using plant dyes is a method for dyeing fibers by using an extract (pigment or the like) extracted from a natural plant. Upon using the method, since only the use of an extract derived from a natural plant provides a pale color tone, a mordanting process using metal ions and the like, that is, a deep-color applying process, is often carried out.

The advantages of the coloring method using plant dyes are that since the extract is a material of natural origin, it is possible to provide an ecological-friendly method, and that since natural products are used, even subtle differences in color tones of the same type are available. In contrast, from the viewpoint of industrial products, the disadvantages of the coloring method using plant dyes include poor color fastness to light, deviations in quality due to the use of a natural product and difficulty in color reproducibility.

In the field of hair dyes such as white-hair dyes, as has been conventionally known by, for example, Patent Document 1, a hair dyeing agent of black type in which a pre-treatment agent (reduction agent), polyphenols, a solution of water-soluble salt of iron or copper and an oxidizer (hydrogen peroxide) are used has been proposed. However, Patent Document 1 relates to a technique in the white-hair dyeing field for human hair, and the degree of fastness of dyed hair is not called for so much in the field of hair dyes such as white-hair dyes.

With respect to a coloring technique without using a dye, for example, Patent Document 2 is listed, and this method uses an organic solvent, and causes disadvantages in that the method is not applicable to a current dyeing machine (new facility investments for acid resistant specifications and the like are required) and in that this method causes serious damages to a polyamide tangible matter and imposes a big load on the environment.

Patent Document 3 provides fibers that are colored blue or black through a reaction of iron ions and tannic acid; however, the evaluation about its physical properties (degree of color fastness) is poor.

Patent Document 1: Japanese Patent Publication No. 58-45401

Patent Document 2: Japanese Patent Laid-Open Publication No. 2001-055672

Patent Document 3: Japanese Patent Laid-Open Publication No. 2000-143683

DISCLOSURE OF THE INVENTION

Problems to be Solved by the Invention

The present invention has been made to solve the above-mentioned problems, and its objective is to provide a coloring method of a polyamide tangible matter, which carries out a coloring process without using any dye and provides a colored polyamide tangible matter excellent in fastness to light with good reproducibility, and such a colored polyamide tangible matter manufactured through the coloring method.

Means to Solve the Problems

The present invention relates to a coloring method of a tangible matter having a polyamide bond including the step of: treating the tangible matter having a polyamide bond in an aqueous solution containing an aromatic derivative having one or more hydroxyl groups and a metal salt at a temperature of 40° C. or more, and also concerns a colored polyamide tangible matter manufactured through such a coloring method.

The polyamide tangible matter used in the present invention refers to a material such as leather, silk, wool or nylon. The form of the tangible matter is prepared as any one of cotton, string, woven fabric, knit fabric, non-woven fabric and fiber products. In the present invention, a polyamide tangible matter of this type is treated in an aqueous solution containing an aromatic derivative having one or more hydroxyl groups and a metal salt under a normal pressure at a temperature in a range from 40 to 100° C., preferably from 45 to 100° C., so that the polyamide tangible matter is colored. When the treatment temperature is too low, the coloring development is not sufficient, and the degree of fastness becomes insufficient. When the treatment temperature is too high, problems such as reduced strength are raised, failing to provide a desirable method.

Examples of the aromatic derivative having one or more hydroxyl groups include: hydroxybenzoic acid, hydroxybenzaldehyde, dihydroxybenzene, dihydroxybenzoic acid, dihydroxybenzaldehyde, trihydroxybenzene, trihydroxybenzoic acid, trihydroxybenzaldehyde, tannic acid and esters thereof. These substances may be prepared as salts of sodium, potassium or the like. These substances may be used alone, or two or more of these may be used in combination.

Examples of metal salt include: salts of heavy metals, such as iron (II or III) salts, copper salts, aluminum salts and nickel salts. With respect to the salt, examples thereof include: inorganic salts, such as nitrate, sulfate and chloride, and organic salts, such as acetate and citrate. These salts may be used alone, or two or more of these may be used in combination.

The treatment by the use of an aromatic derivative having one or more hydroxyl groups (hereinafter, referred to simply as "hydroxyl group treatment") and the treatment by the use of a metal salt (hereinafter, referred to simply as "metal salt treatment") may be carried out simultaneously by mixing these substances (hereinafter, referred to simply as "simultaneous treatment of metal salt and hydroxyl groups"), or may be carried out in a separate manner. In the case when the two treatments are carried out separately, after the metal salt treatment has been carried out, the hydroxyl group treatment may be carried out, or after the hydroxyl group treatment has been carried out, the metal salt treatment may be carried out. Preferably, the former order is used. After the metal salt treatment has been carried out, or after the hydroxyl group treatment has been carried out, the polyamide tangible matter is not necessarily required to be dried, and after having been taken out from the aqueous solution, the resulting tangible matter may be washed with water, and subjected to the succeeding processes continuously.

The hydroxyl group treatment is carried out by immersing a polyamide tangible matter in an aqueous solution having a concentration of an aromatic derivative having one or more hydroxyl groups in a range from 0.01 to 15 wt %, preferably from 0.1 to 5 wt %. The immersing process is carried out under a normal pressure at a temperature in a range from 40 to 100° C., preferably from 45 to 100° C., for 0.5 to 3 hours. In addition to the immersing method, another method in which an aqueous solution containing an aromatic derivative having one or more hydroxyl groups is sprayed on the polyamide tangible matter so as to allow the polyamide tangible matter to absorb the aqueous solution may be used.

The metal salt treatment is carried out by immersing a polyamide tangible matter in an aqueous solution having a concentration of a metal salt that is 0.1 to 10 times the concentration of the aromatic derivative having one or more hydroxyl groups. The immersing process is carried out under a normal pressure at a temperature in a range from 40 to 100° C., more preferably from 45 to 100° C., for 0.5 to 3 hours. In addition to the immersing method, another method in which an aqueous solution containing a metal salt is sprayed on the polyamide tangible matter so as to allow the polyamide tangible matter to absorb the aqueous solution may be used.

The simultaneous treatment with the metal salt and hydroxyl groups is carried out in the same manner as the metal salt treatment or the hydroxyl group treatment, except that the concentrations of the metal salt and the aromatic derivative having one or more hydroxyl groups are set in the above-mentioned ranges of concentration. When the treatment temperature is too low, the coloring progress is not sufficient, and the degree of fastness becomes insufficient. When the treatment temperature is too high, problems such as reduced strength are raised, failing to provide a desirable method. The aromatic derivative having one or more hydroxyl groups and the metal salt form a complex to generate a coloring substance. This coloring substance is firmly bonded to the tangible matter having a polyamide bond to provide a colored tangible matter with sufficient fastness.

Dyeing assistant auxiliaries commonly used in dyeing, such as a penetrating agent, a fatliquoring agent and a pH adjustor, may be added to the metal salt treatment solution, the hydroxyl group treatment solution and/or the simultaneous treatment solution of the metal salt and the hydroxyl groups. The penetrating agent is used for improving the penetrating property of the chemicals to the inside of fibers, and upon coloring wool, silk, nylon and the like, an amount of use thereof is preferably set in a range from about 0.1 to about 2.5 wt %. The fatliquoring agent is mainly used for preventing damages to the feel and texture upon drying a leather after its coloring process, and upon coloring oxhide and the like, an amount of use thereof is preferably set in a range from about 0.1 to about 30 wt %.

After the metal salt treatment and the hydroxyl group treatment, the colored polyamide tangible matter is washed with water and dried.

The colored polyamide tangible matter of the present invention can be obtained by coloring and manufacturing, using a conventionally known device such as a continuous dyeing machine and a jet dyeing machine.

With respect to the polyamide tangible matter, a colored polyamide tangible matter that is colored without using any dye (non-dye) is obtained through the above-mentioned processes. The colored polyamide tangible matter is superior in fastness to light. Examples of the colors include dark blue, yellow, green and mixed colors of these; more specifically, dark brown, dark blue, yellow, purplish red, brown, beige, gray, brown, reddish brown, black and the like are available. With respect to these coloring processes, by selecting the kinds of the aromatic derivative having one or more hydroxyl groups and metal salt and adjusting the conditions, the color is appropriately selected and adjusted. By carrying out the hydroxyl group treatment or the metal salt treatment under high-temperature and high-concentration conditions, the color density can be increased; in contrast, by carrying out these treatments under low-temperature and low-concentration conditions, the color density can be reduced.

EFFECTS OF THE INVENTION

Since no dye is used, it is possible to reduce a load imposed on the environment.

A deep coloring process is available.

A continuous coloring process is available.

The resulting product is superior in fastness to light with good reproducibility.

The presence or absence of a biogenic protein can be detected by using an aqueous solution containing an aromatic derivative having one or more hydroxyl groups and a metal salt to be used in the present invention.

For example, an aqueous solution of albumin derived from eggs (made by Wako Pure Chemical Industries, Ltd.) is developed on polyacrylamide gel through an electrophoretic method by using normally-used processes. For example, a 3% aqueous iron chloride (III)(made by Wako Pure Chemical Industries, Ltd.) solution is allowed to penetrate this gel for 30 minutes at room temperature, and after the gel has been washed, a 0.1% aqueous gallic acid monohydrate (made by Wako Pure Chemical Industries, Ltd.) solution is allowed to further penetrate the gel for 10 minutes at room temperature so that a developed protein portion is colored into black; thus, the developed protein can be detected. Upon detecting protein of this type, the treatment temperature is set in a range from about 5 to about 35° C. With respect to the other treatment conditions, the same conditions and method as the treatment conditions of the above-mentioned polyamide tangible matter can be used.

EXAMPLES (Wool)

Example 1

A solution of 0.2 wt % 3,4-dihydroxybenzaldehyde (made by Wako Pure Chemical Industries, Ltd.), 0.5 wt % iron chloride (II) (made by Wako Pure Chemical Industries, Ltd.) and 0.2 wt % penetrating agent (MAC-100S made by Kyoeisha Chemical Co., Ltd.) was prepared, and an untreated woven wool textile was put into the solution and treated at 98° C. for one hour, and then washed with water and dried.

Example 2

A solution of 0.5 wt % 3,4-dihydroxybenzaldehyde (made by Wako Pure Chemical Industries, Ltd.), 2.5 wt % iron chloride (II) (made by Wako Pure Chemical Industries, Ltd.) and 0.2 wt % penetrating agent (MAC-100S made by Kyoeisha Chemical Co., Ltd.) was prepared, and an untreated woven wool textile was put into the solution and treated at 98° C. for one hour, and then washed with water and dried.

Example 3

A solution of 1 wt % iron chloride (III) (made by Wako Pure Chemical Industries, Ltd.) and 0.2 wt % penetrating agent (MAC-100S made by Kyoeisha Chemical Co., Ltd.) was prepared, and an untreated woven wool textile was put into the solution and treated at 98° C. for one hour, and then washed with water. Then, a solution of 0.5 wt % gallic acid (made by Wako Pure Chemical Industries, Ltd.) and 0.2 wt % penetrating agent (MAC-100S made by Kyoeisha Chemical Co., Ltd.) was prepared, and the textile that had been treated was put into the solution and treated at 98° C. for one hour, and then washed with water and dried.

Example 4

A solution of 0.2 wt % 3,4-dihydroxybenzaldehyde (made by Wako Pure Chemical Industries, Ltd.), 0.4 wt % aluminum acetate (made by Wako Pure Chemical Industries, Ltd.) and 0.2 wt % penetrating agent (MAC-100S made by Kyoeisha Chemical Co., Ltd.) was prepared, and an untreated woven wool textile was put into the solution and treated at 50° C. for one hour, and then washed with water and dried.

Example 5

A solution of 0.2 wt % 2,6-dihydroxybenzoic acid (made by Wako Pure Chemical Industries, Ltd.), 0.4 wt % iron chloride (II) (made by Wako Pure Chemical Industries, Ltd.) and 0.2 wt % penetrating agent (MAC-100S made by Kyoeisha Chemical Co., Ltd.) was prepared, and an untreated woven wool textile was put into the solution and treated at 50° C. for one hour, and then washed with water and dried.

Example 6

A solution of 0.1 wt % 3,4-dihydroxybenzaldehyde (made by Wako Pure Chemical Industries, Ltd.), 0.1 wt % 2,4-dihydroxybenzaldehyde (made by Wako Pure Chemical Industries, Ltd.), 0.2 wt % iron chloride (II) (made by Wako Pure Chemical Industries, Ltd.) and 0.2 wt % penetrating agent (MAC-100S made by Kyoeisha Chemical Co., Ltd.) was prepared, and an untreated woven wool textile was put into the solution and treated at 50° C. for one hour, and then washed with water and dried.

Comparative Example 1

The same processes as those of Example 1 were carried out except that the treatment temperature was set to 30° C. so that an untreated woven wool textile was treated.

(Oxhide)

Example 7

To 20.4 ml of an aqueous solution containing 0.27 g of gallic acid monohydrate (made by Wako Pure Chemical Industries, Ltd.) and 0.54 g of iron chloride (III) (made by Wako Pure Chemical Industries, Ltd.) was added 13.6 g of oxhide, and the treatment was conducted at 45° C. for 30 minutes. To the resulting reaction solution was added 0.82 g of a fatliquoring agent (Sandolix JAK (made by Clariant (Japan) K. K.)), and the mixture-was treated at 45° C. for 30 minutes so that the oxhide was colored to black. After the completion of the reaction, the resulting oxhide was washed with water three times, and dried at room temperature.

Comparative Example 2

To 20.1 ml of an aqueous solution containing 1.6 g of Acid Black 1 (made by Tokyo Kasei Kogyo Co., Ltd.) was added 13.4 g of oxhide, and the treatment was conducted at 45° C. for 30 minutes. To the resulting reaction solution was added 0.8 g of a fatliquoring agent (Sandolix JAK (made by Clariant (Japan) K. K.)), and the mixture was treated at 45° C. for 30 minutes, and 0.8 ml of formic acid was further added thereto, and the mixture was treated at 45° C. for 20 minutes so that the oxhide was colored to deep dark blue. After the completion of the reaction, the resulting oxhide was washed with water three times, and dried at room temperature.

Example 8

To 0.9 ml of an aqueous solution containing 15 mg of 3,4-dihydroxybenzaldehyde (made by Tokyo Kasei Kogyo Co., Ltd.), 12 mg of iron chloride (II) (made by Wako Pure Chemical Industries, Ltd.) and 6 mg of sodiumhydrogen carbonate (made by Kishida Chemical Co., Ltd.) used for adjusting a pH value to 6 was added 0.3 g of oxhide, and the treatment was conducted at 45° C. for 30 minutes. To the resulting reaction solution was added 18 mg of a fatliquoring agent (Sandolix JAK (made by Clariant (Japan) K. K.)), and the mixture was treated at 45° C. for 30 minutes so that the oxhide was colored to black. After the completion of the reaction, the resulting oxhide was washed with water three times, and dried at room temperature.

Example 9

To 0.9 ml of an aqueous solution containing 15 mg of 2,4-dihydroxybenzaldehyde (made by Tokyo Kasei Kogyo Co., Ltd.) and 15 mg of iron chloride (II) (made by Wako Pure Chemical Industries, Ltd.) was added 0.3 g of oxhide, and the reaction was conducted at 45° C. for 30 minutes. To the resulting reaction solution was added 18 mg of a fatliquoring agent (Sandolix JAK (made by Clariant (Japan) K. K.)), and the mixture was treated at 45° C. for 30 minutes so that the oxhide was colored to brown. After the completion of the reaction, the resulting oxhide was washed with water three times, and dried at room temperature.

(Silk)

Example 10

An aqueous solution (100 ml) containing 0.2 g of 3,4-dihydroxybenzaldehyde (made by Tokyo Kasei Kogyo Co., Ltd.), 0.4 g of iron chloride (III) (made by Wako Pure Chemical Industries, Ltd.) and 0.05 ml of nonionic penetrating agent (MAC-100S made by Kyoeisha Chemical Co., Ltd.) was prepared, and 3.3 g of a silk-added white cloth No. 2-2 (JIS L 0803) was put into the solution and treated at 70° C. for 60 minutes. After the completion of the reaction, the resulting cloth was washed with water, and dried at room temperature to obtain a gray-colored sample.

Example 11

An aqueous solution (100 ml) containing 0.1 g of gallic acid monohydrate (made by Wako Pure Chemical Industries, Ltd.), 0.1 g of iron chloride (II) (made by Wako Pure Chemical Industries, Ltd.) and 0.05 ml of nonionic penetrating agent (MAC-100S made by Kyoeisha Chemical Co., Ltd.) was prepared, and 3.3 g of a silk-added white cloth No. 2-2 (JIS L 0803) was put into the solution and treated at 70° C. for 60 minutes. After the completion of the reaction, the resulting cloth was washed with water, and dried at room temperature to obtain a dark-blue-colored sample.

Example 12

An aqueous solution (100 ml) containing 0.2 g of 2,4-dihydroxybenzaldehyde (made by Tokyo Kasei Kogyo Co., Ltd.), 0.4 g of iron chloride (II) (made by Wako Pure Chemical Industries, Ltd.) and 0.05 ml of nonionic penetrating agent (MAC-100S made by Kyoeisha Chemical Co., Ltd.) was prepared, and 3.3 g of a silk-added white cloth No. 2-2 (JIS L 0803) was put into the solution and treated at 70° C. for 60 minutes. After the completion of the reaction, the resulting cloth was washed with water, and dried at room temperature to obtain a reddish-brown-colored sample.

The coloring of each of the cloths obtained in Examples 1 to 12 and Comparative Example 1 was measured by Spectro Color Meter SE2000 (NDK, Ltd.) and a Lab-diagram was obtained. In addition, fastness-to-light tests (pursuant to JIS L 0842) and fastness-to-water tests (pursuant to JIS L 0846) were carried out on the cloths. Table 1 shows the results.

TABLE 1

| | Lab-diagram and results of fastness-to-light tests of the resulting cloths | | | | | |
|---|---|---|---|---|---|---|
| Examples | Color | L | a | b | Fastness-to-light (class) | Fastness-to-water (class) |
| 1 | Dark brown | 19.32 | 1.07 | 2.20 | 4 or more | — |
| 2 | Black | 14.13 | 0.08 | −0.32 | 4 or more | — |
| 3 | Dark blue | 13.80 | 0.61 | −1.53 | 4 or more | — |
| 4 | Yellow | 75.8 | −4.2 | 31.1 | 4 | — |
| 5 | Purplish red | 51.8 | 12.8 | 8.3 | 4 | — |
| 6 | Beige | 48.2 | 7.6 | 13.2 | 4 | — |
| 7 | Black | 19.21 | 0.42 | −0.62 | — | 3-4 |
| 8 | Black | 20.48 | 1.17 | 0.93 | — | — |
| 9 | Brown | 34.37 | 11.2 | 10.42 | — | — |
| 10 | Gray | 37.92 | 0.37 | 6.79 | 4 | — |
| 11 | Dark blue | 23.42 | 2.34 | −5.13 | 5 | — |
| 12 | Reddish brown | 47.98 | 6.91 | 13.19 | 4 | — |
| Comparative Example 1 | Gray | 58.13 | 1.94 | 3.88 | less than 3 | — |
| Comparative Example 2 | Deep dark blue | 18.93 | 0.17 | −5.05 | — | 1 |

(Nylon)

Example 13

An aqueous solution (100 ml) containing 0.2 g of 3,4-dihydroxybenzaldehyde (made by Tokyo Kasei Kogyo Co., Ltd.), 0.4 g of iron chloride (II) (made by Wako Pure Chemical Industries, Ltd.) and 0.05 ml of nonionic penetrating agent (MAC-100S made by Kyoeisha Chemical Co., Ltd.) was prepared, and 3.3 g of a nylon-added white cloth No. 7 (JIS L 0803) was put into the aqueous solution and treated at 95° C. for 60 minutes. After the completion of the reaction, the resulting cloth was washed with water, and dried at room temperature to obtain a reddish-black-colored sample.

Example 14

An aqueous solution (100 ml) containing 0.1 g of gallic acid monohydrate (made by Wako Pure Chemical Industries, Ltd.), 0.1 g of iron chloride (II) (made by Wako Pure Chemical Industries, Ltd.) and 0.05 ml of nonionic penetrating agent (MAC-100S made by Kyoeisha Chemical Co., Ltd.) was prepared, and 3.3 g of a nylon-added white cloth No. 7 (JIS L 0803) was put into the aqueous solution and treated at 95° C. for 60 minutes. After the completion of the reaction, the resulting cloth was washed with water, and dried at room temperature to obtain a gray-colored sample.

Example 15

An aqueous solution (100 ml) containing 0.2 g of 2,3,4-trihydroxybenzophenone (made by Tokyo Kasei Kogyo Co., Ltd.), 0.4 g of iron chloride (II) (made by Wako Pure Chemical Industries, Ltd.) and 0.05 ml of nonionic penetrating agent (MAC-100S made by Kyoeisha Chemical Co., Ltd.) was prepared, and 3.3 g of a nylon-added white cloth No. 7 (JIS L 0803) was put into the aqueous solution and treated at 95° C. for 60 minutes. After the completion of the reaction, the resulting cloth was washed with water, and dried at room temperature to obtain a green-colored sample.

The coloring of each of the cloths obtained in Examples 13 to 15 was measured by Spectro Color Meter SE2000 (NDK, Ltd.) and a Lab-diagram was obtained. In addition, fastness-to-light tests (pursuant to with JIS L 0842) and fastness-to-water tests (pursuant to JIS L 0846) were carried out on the cloths. Table 2 shows the results.

TABLE 2

| | Lab-diagram and results of fastness-to-light tests of the resulting nylon cloths | | | | |
|---|---|---|---|---|---|
| Examples | Color | L | a | b | Fastness-to-light (class) |
| 13 | Reddish black | 21.48 | 1.49 | 0.62 | 4 or more |
| 14 | Gray | 31.86 | 1.90 | 0.10 | 4 |
| 15 | Green | 35.19 | −0.22 | 8.48 | 4 or more |

Comparative Examples 3 to 7

An aqueous solution (84 ml) containing 0.17 g of gallic acid monohydrate (made by Wako Pure Chemical Industries, Ltd.), 0.17 g of iron chloride (II) (made by Wako Pure Chemical Industries, Ltd.) and 0.05 ml of nonionic penetrating agent (MAC-100S made by Kyoeisha Chemical Co., Ltd.) was prepared, and 2.8 g of a Union Cloth No.1 of multiple-fiber union cloth (JIS L 0803) was put into the aqueous solution and treated at 95° C. for 60 minutes. After the completion of the reaction, the resulting cloth was washed with water, and dried at room temperature. Table 3 shows the Lab-diagram obtained from each of the types of fabrics. Table 3 shows that no materials other than the polyamide tangible matter were colored.

TABLE 3

| | Lab-diagram of the resulting multiple-fiber union cloths | | | | |
|---|---|---|---|---|---|
| Comparative Examples | Fiber types | Color | L | a | b |
| 3 | Cotton | White | 77.59 | 0.43 | 3.74 |
| 4 | Acetate | White | 75.23 | 0.23 | 4.7 |
| 5 | Rayon | White | 83.76 | −0.02 | 4.09 |
| 6 | Acrylic | White | 76.24 | −0.98 | 5.14 |
| 7 | Polyester | White | 83.85 | 0.11 | 3.26 |

The invention claimed is:

1. A coloring method of a tangible matter having a polyamide bond, consisting essentially of treating the tangible matter having a polyamide bond with an aqueous solution containing an aromatic derivative having one or more hydroxyl groups selected from the group consisting of dihydroxybenzoic acid, dihydroxybenzaldehyde, trihydroxybenzoic acid and trihydroxybenzaldehyde, and a metal salt selected from the group consisting of iron (II or III) salt, copper salt, aluminum salt and nickel salt, wherein the salt is a nitrate, sulfate, chloride, acetate or citrate, at a temperature of 45° C. to 100° C., simultaneously or separately, wherein the treatment time ranges from 0.5 to 3 hours and the tangible matter is colored without using any dye.

2. The coloring method of a tangible matter according to claim 1, wherein the metal salt is an iron salt.

3. The method according to claim 1, wherein the treating steps are performed separately.

4. The method according to claim 1, wherein the aqueous solution further comprises a dyeing assistant agent which is selected from the group consisting of a penetrating agent, a fatliquoring agent and a pH adjustor.

* * * * *